United States Patent [19]

Varis

[11] Patent Number: 5,048,377

[45] Date of Patent: Sep. 17, 1991

[54] GRIPPING AND ROTATING TONG DEVICE

[76] Inventor: Matti Varis, SF-99300 Muonio, Finland

[21] Appl. No.: 469,445

[22] PCT Filed: Oct. 7, 1988

[86] PCT No.: PCT/FI88/00164

§ 371 Date: May 30, 1990

§ 102(e) Date: May 30, 1990

[87] PCT Pub. No.: WO89/03470

PCT Pub. Date: Apr. 20, 1989

[30] Foreign Application Priority Data

Oct. 8, 1987 [FI] Finland ..... 874439

[51] Int. Cl.[5] ..... B25B 17/00

[52] U.S. Cl. ..... 81/57.15; 81/57.3; 81/57.33; 81/58.2

[58] Field of Search ..... 81/57, 57.15–57.22, 81/57.3, 57.33, 58.2

[56] References Cited

U.S. PATENT DOCUMENTS

| | | | |
|---|---|---|---|
| 2,000,221 | 5/1935 | Dawson | 81/57.16 |
| 2,550,045 | 4/1951 | De Hetre | 81/57.18 |
| 2,573,212 | 10/1951 | Martois | 81/57.24 |
| 3,196,717 | 7/1965 | Sheppard | 81/57.2 |
| 4,060,014 | 11/1977 | Turner | 81/57.2 |

*Primary Examiner*—James G. Smith

*Attorney, Agent, or Firm*—Cushman, Darby & Cushman

[57] ABSTRACT

A gripping and rotating tong device for handling drill rods, drill bits and other corresponding, at least partially rod-like pieces. The tong device comprises a housing fastened to a movable transfer device, the housing having an axial hole and a radial aperture for taking the piece to be handled from outside the housing to inside it, and in the housing it has grippers which grip the workpiece introduced into the housing, and parts for rotating the grippers. The grippers include at least two locking ring gears which rest in bearings rotatably in relation to the housing, at least one of them having cogging on the outer periphery and each having a notch extending to the center, along which notch the workpiece can pass to the center of the ring gears and away from them. The rotating of the ring gears is effected by at least one gear, the workpiece centered with the ring gears rotating together with them. The centering and/or releasing of the workpiece is effected by a limited turning of one ring gear in relation to the other ring gear, produced by the starting, ending or changing of direction of the rotation.

6 Claims, 4 Drawing Sheets

GRIPPING AND ROTATING TONG DEVICE

BACKGROUND OF THE INVENTION

The invention relates to a gripping and rotating tong device for handling drill rods, drill bits and other corresponding, at least partially rod-like pieces, the tong device comprising a housing which is fastened to movable transfer means and has an axial hole and a radial aperture for the taking of the piece to be handled from outside the housing to inside the housing; in the housing, gripping means which grip the piece entering the housing; and parts for rotating the gripping means selectively in either direction. The invention also relates to the use of the gripping and rotating tong device for handling drill rods, rock bolts, drill bits and other corresponding, at least partially rod-like pieces.

It is previously known to handle drill rods, rock bolts and drill bits by means of mechanical devices. In a conventional construction, the drill rods or corresponding pieces are placed in either a circular magazine or a chain magazine, from where a rod-retrieving device outside the magazine is capable, by means of tongs, of transferring one rod at a time to the rod chuck or other point of use, and, in a corresponding manner, removing the rod from it. Thereafter the item transferred into place, for example a drill rod, is connected as an extension to a previous drill rod by means of a screw joint, which requires that the drill rod be rotated. This rotation can be effected, for example, by using the rotation motor of the drilling machine, totally separate rotation devices connected to the rod chuck, or rotation devices connected to the rod-retrieving device. Such constructions are disclosed, for example, in U.S. Pat. Nos. 3 506 075 and 2 972 388, in Finnish Patent Application 843 734, and in Finnish Patent 65 471. In the last-mentioned Finnish patent, the rotation device includes rolls acting against the rod, some of the rolls being driven by hydraulic motors in order to rotate the rod. Patent 65 471 also includes a device, separate from the handling devices, for transferring and holding the drill bits. This drill bit replacer is made up of a basket-like part which grips the drill bit and is fastened to a pivot arm by means of which the drill bit is transferred to the rod. The drill bit is fastened by rotating the rod and not the drill bit.

There are also devices in which the gripping means and the rod-rotating mechanism are combined. German Patent DE-3 521 923 describes a device for making and detaching pipe joints, the device having inside a housing two gripping jaws which can be pressed against the pipe or the rod. The aperture into which the pipe has been introduced in order to be pressed or rotated is closed with a separate closing piece. The closing piece has no mechanism; instead, the pipe is rotated by rotating the piece to which the gripping jaws are fastened. The said two gripping jaws are made up of pieces capable of pivoting about a hinge pin towards the pipe. Patent GB-2 100 639 discloses a construction and its closing piece, otherwise corresponding to the above-mentioned German patent, except that the jaws for gripping the rod are driven by transmission of two rings placed one above the other and rotating in relation to each other, whereas in the German patent there are means one inside the other for this purpose. Furthermore, U.S. Pat. No. 4 060 014 discloses a corresponding construction with its closing piece, the purpose of the construction being to enable the workpiece to be rotated in both directions at any time without the gripping jaws opening from around the workpiece. This patent discloses use of only one ring gear but a large number of other cogged means. Norwegian Patent Application 860 054 discloses a similar construction, but without a closing piece. This construction also has a housing part, into the center of which a pipe can be introduced from the side through an aperture in it. This housing, and thereby the pipe, is rotated by ring gear transmission. The pipe, for its part, is locked in relation to the housing by means of three gripping jaws, one of which is pivotable and the other two are fixed in the holder of the locking pieces. The locking pieces with their gripping jaws are driven by means of two cams and a corresponding lever curve by means of which the gripping jaws are caused to pivot and press the pipe.

All of these constructions which have been described have a large number of disadvantages. In the first-mentioned devices, which have separate rotation devices and in which the drill rods are transferred by separate gripping arms from the magazine to the point of work, the disadvantages include the fact that the devices are extremely complicated and include several actuators. Consequently, such mechanisms are very expensive and since, owing to the large number of units, they also require a great deal of space, their installation in machine tools which have little space available around the drilling device itself may be impossible.

In this sense, the gripping and rotating devices which have been described are more advantageous, since they can be installed in a clearly smaller space than the systems provided with separate transfer and rotating devices. In the cases of Patents DE-3 521 923, GB-2 100 639, and U.S. Pat. No. 4 060 014, the disadvantage is, however, the space required by the closing piece of the aperture upon its opening, which space must be taken into consideration in planning the paths of movement of the tong and the rest of the system. In addition, in these constructions the drive mechanism will be complicated, since the closing function and the rotating function have to be controlled separately. In particular, the device of Patent GB-2 100 639 has the disadvantage that one ring gear has to be braked continually in order for the device to function. This prevents rotation over long periods. The construction of Norwegian Patent Application 860 054 has a disadvantage in its complexity, which increases the price and decreases the operational reliability of the device. In addition, owing to the structure, the outer diameter of this device is rather great as compared with the diameter of the rod or pipe to be handled; this complicates the installation of the device in many machines. The same also applies to the devices of Patents GB-2 100 639 and U.S. Pat. No. -4 060 014.

The fact that the known devices are so large that they cannot always be installed have important consequences also for occupational safety, especially in connection with rock-drilling machines. In such cases the machine operator has to carry out the replacement of the drill rod or the drill bit at least partially by hand, which is clearly dangerous. In addition, such manual replacing slows down the work, since the machine has to be stopped for the duration of the replacing, and the machine operator himself must move to the drilling device to carry out the replacing and then again return to continue the drilling.

SUMMARY OF THE INVENTION

With the help of the device according to the invention, a substantial improvement is achieved regarding the disadvantages described above.

It can be deemed that the most important advantage of the invention is that the device is so small in relation to the drill rod itself or any other corresponding piece to be handled that the gripping and rotating tong device, together with its transfer means, can be installed inside the chain magazine or circular magazine for the drill rods, rock bolts or drill bits. In this case, the mechanism, ready for operation, takes precisely as much space as does the magazine involved, since no external transfer or rotation devices are required. In addition, the gripping and rotating tong device is so simple in construction that its price is insignificant compared with the prices of the other components of the drilling equipment or the prices of the previously known transfer and rotation devices, and that the operational reliability of the device is very good. The operational reliability and the economy of price are further increased by the fact that the construction is not sensitive to errors in dimensioning any more than to impurities from the environment. This provides a very great advantage specifically in rock drilling and mining activity. Since, owing to the economical price and small size of the device, it is possible to install it wherever replacing work is required, an advantage is gained also in the form of improved occupational safety and savings in working hours. It is a further advantage of the construction that the device can be retro-installed in machines which are already in operation and can be transferred from one machine to another.

BRIEF DESCRIPTION OF THE DRAWINGS

The invention is described below in detail with reference to the accompanying drawings.

In the Drawings.

DETAILED DESCRIPTION

Figure 1:
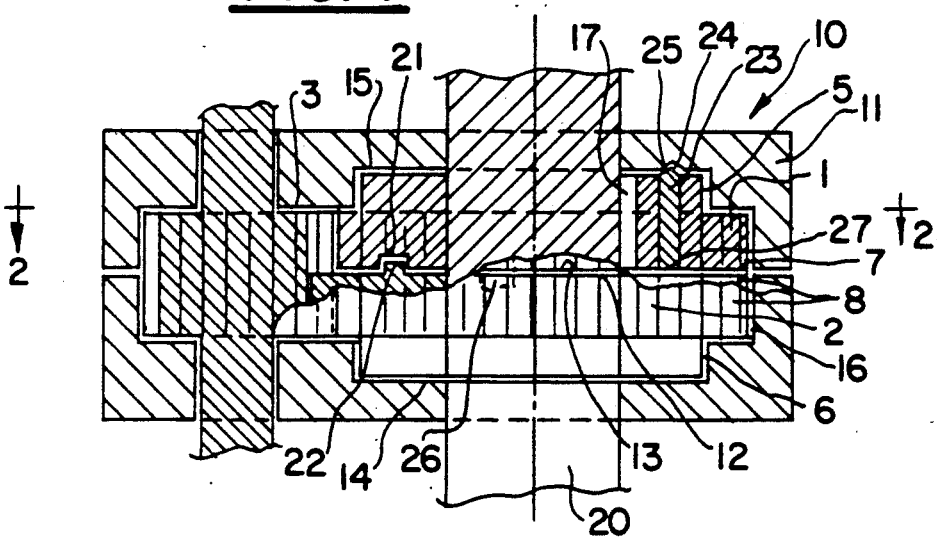
FIG. 1 is a side elevational view, partly in longitudinal section, of a first embodiment of a gripping and rotating tong device in accordance with principles of the present invention, shown operating on a rod.
Figure 2:
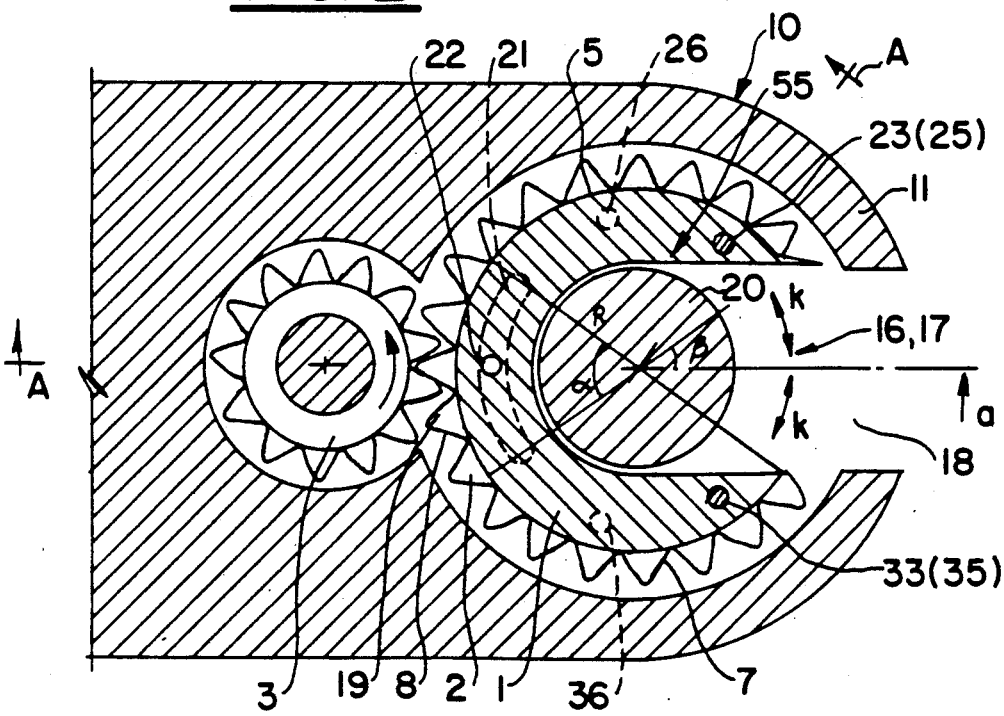
FIG. 2 is a horizontal transverse sectional view taken on line 2—2 of FIG. 1.

FIGS. 2 and 1 respectively depict one embodiment of the gripping and rotating tong device according to the invention as a cross-sectional plan view and as a partially cross-sectional side elevation, the housing being sectioned along the center line. The gripping tong 10 is made up of a housing part 11 and two concentric ring gears 1 and 2, both of which are supported concentrically in bearings in the housing 11. In each ring gear 1 and 2, the cogging and the bearings are also concentric. In other words, the bearings and the cogging of the ring gear 1 and the bearings and the cogging of the ring gear 2 are all mutually concentric. In this embodiment, each cogged gear 1, 2, outer periphery is made up, in part, of a smaller-diameter cylindrical portion 5, 6, the outer surface of which constitutes a slide bearing in relation to the housing 1. External gear cogging has been machined into the larger-diameter cylindrical portions 7, 8, respectively of the ring gears 1 and 2. These ring gears 2 and 1 are installed inside the housing 11 in such a manner that the cogged portions 7 and 8 rest against each other on their end surfaces 12 and 13, respectively which are perpendicular to their rotation-symmetry axes. In the housing 11 there are cylindrical mating slide surfaces corresponding to both slide surfaces 5 and 6 in order to form slide bearings, as well as mating slide surfaces corresponding to the smaller-diameter end surfaces 14 and 15, facing away from each other, of the ring gears. The ring gears 1 and 2 are thus located inside the housing 11 in such a manner that they can rotate about their joint rotation-symmetry axis either together or separately, the surfaces 12 and 13 of the ring gears sliding in relation to each other but not being substantially capable of moving away from each other in the direction of the rotation-symmetry axis or in the peripheral direction so as to become eccentric in relation to each other. Both of these ring gears 1 and 2 are driven by a gear 3, the axis of which is parallel to the rotation-symmetry axis of the ring gears and the cogging of which has been adapted to their cogging. The housing 11 may be made up of halves which may be interconnected by any method deemed suitable.

In the center of the ring gears there is a hole in which the drill rod or other corresponding cylindrical piece or similar part of a piece to be handled fits, and from this axial hole there is a radial aperture outwards in such a manner that a notch 16 is formed in the ring gear 2, and respectively a notch 17 in the ring gear 1, for introducing the rod 20 to be handled from outside the cogged peripheries to their center, while maintaining the axial direction of the rod approximately parallel to the axis of the ring gears. In the housing 11 there is a corresponding aperture 18 for introducing the rod 20 to be handled from outside the housing 11 through its wall and further to the center of the ring gears.

Furthermore, the cogging of the ring gear 1 has been eliminated in an area in alignment with the gear 3, in other words in this case on the side opposite to the notch 17, over such a portion of the periphery that, when the notch 17 is in alignment with the aperture 18 of the housing, the gear 3 is exactly in the middle of this uncogged portion 19, in which case the gear 3 cannot touch the teeth of the ring gear 1. One advantageous length for the uncogged portion 19 is such that the central angle $\alpha$ corresponding to the length of the arc of the portion 19 is double, compared with the angle k of the rotation which effects the locking of the ring gears 1 and 2. In other words, $\alpha=2\times k$. Typically $\alpha$ is the same as the opening angle $\beta$ of the notch 17, in which case $\beta=2\times k$. On the periphery portion 19 defined by this angle $\alpha$, the radius R of the ring gear 1 is thus at most the radius of the root of the cogging of the gear 1 portion of the ring gear.

Figure 3:
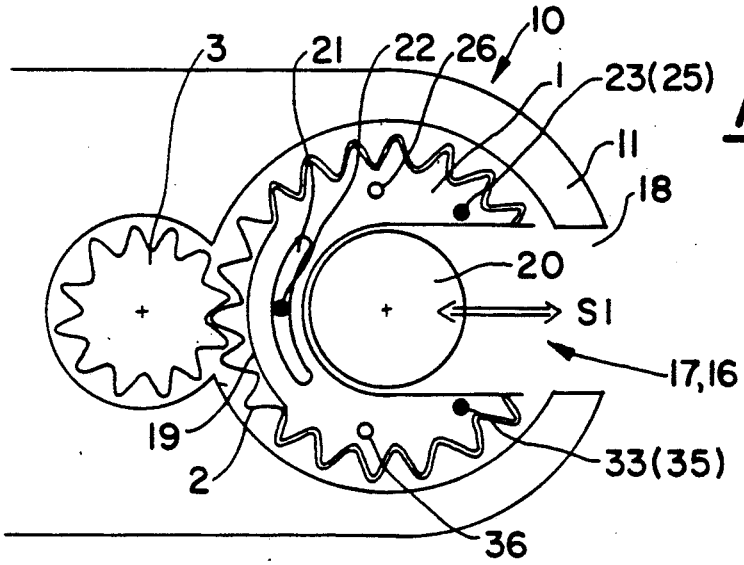
FIGS. 3, 4 and 5 are diagrammatic top plan views, generally comparable to FIG. 2, depicting different steps in operation of the gripping and rotating device of FIGS. 1 and 2.

The basic form of the gripping and rotating tong device described above works as follows. In FIG. 3, the ring gears 1 and 2 are in such a position that their notches 17 and 16 are in alignment and at the same time in alignment with the aperture 18 of the housing. In this case the rod-like piece 20 can be taken from outside the housing to the center of the ring gears and away from there in directions S1, when the tong device 10 is pressed, for example, onto a drill rod in the magazine. The inner surface of the notch 17 of the ring gear 1, over a distance corresponding to the diameter of the drill rod as calculated from the bottom of the notch, has been typically shaped so or coated or provided with such a mechanism that, when the tong device 10 is pushed onto the drill rod 20, so much pressure is produced between them that the friction force between the rod 20 and the ring gear 1 is greater than the friction force between the ring gears 1 and 2 when they are rotated in relation to each other. Thereafter, when the rotating of the gear 3 is started, the ring gear 2, which has cogging over its entire periphery, begins to rotate in a corresponding manner in direction S2. At this stage the ring gear 1 remains in place because of the above-mentioned difference in friction, since its cogged periphery has an uncogged portion 19 in alignment with the gear 3. The fact that the ring gear 1 remains in place, with respect to the housing, is, however, not necessary for the functioning of the device, but usually it is advantageous.

The ring gear 1 has in its end surface 13, which is against the ring gear 2, a circularly arcuate groove 21, the annular length of which (in a circumvential direction) also corresponds to the central angle $\alpha$. The ring gear 2, for its part, has in the end surface 12, which comes against the ring gear 1, a protruding pin 22 which precisely fits to move in the groove 21. Now, when the cogged periphery 2 has turned over an angle of $\alpha/2$, in other words over the rotation angle k, whereupon the notch 16 of the ring gear 2 has turned to such a position that typically its trailing edge has just closed the leading edge of the notch 17 of the ring gear 1, the pin 22 has moved in the groove 21 as far as its end. This situation is depicted FIG. 4. At this time, the rod 20 is locked in the center of the ring gears 1 and 2 so that it cannot rotate or escape from the tong. When the rotation of the gear 3 is discontinued at this stage, it is now possible by means of the tong 10 to transfer the rod 20 to a point of use.

Figure 5:
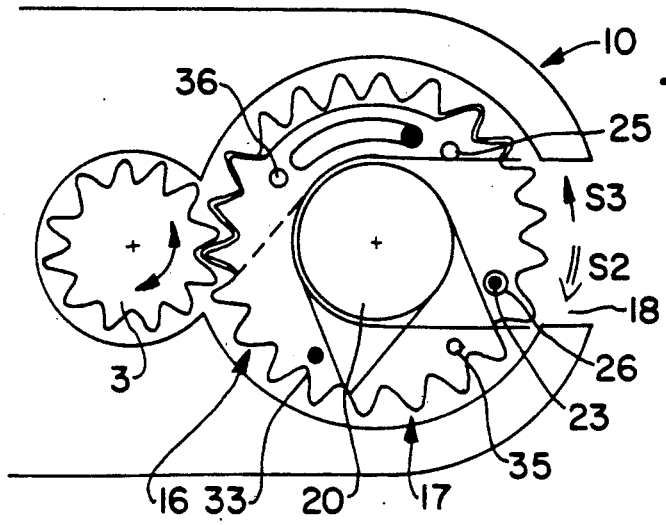

When the rod 20 has, in the manner described above, been taken out of the magazine and transferred to a point of use by means of the tong 10 and at the same time been placed at the desired point and in the desired position, the next step can be the rotation of the rod 20, for example, in order to produce a screw joint. This rotation of the rod 20 is effected by continuing the rotation of the ring gears 1 and 2 by the gear 3 further in direction S2. This is possible, since in this position the ring gears 1 and 2 together form a ring with an uninterrupted cogged periphery, which is formed as follows: the uninterrupted portion of the cogged periphery of the ring gear 1 closes the notch 16 of the ring gear 2 and the uninterrupted portion of the cogged periphery of the ring gear 2 closes the notch 17 of the ring gear 1, and likewise the uninterrupted portion of the cogged periphery of the ring gear 2 closes the uncogged portion 19 of the ring gear 1, and since the axial length of the gear 3 is the same as the combined total axial length of the ring gears 1 and 2. At this time, the gear 3 rotates the whole assembly formed by the ring gears 1 and 2 at every moment of time, at least in one of the ring gears. This situation is shown in FIG. 5. When the ring gears 1 and 2 are in this position in relation to each other, they can be rotated in direction S2 over an unlimited number of rotations.

Figure 4:
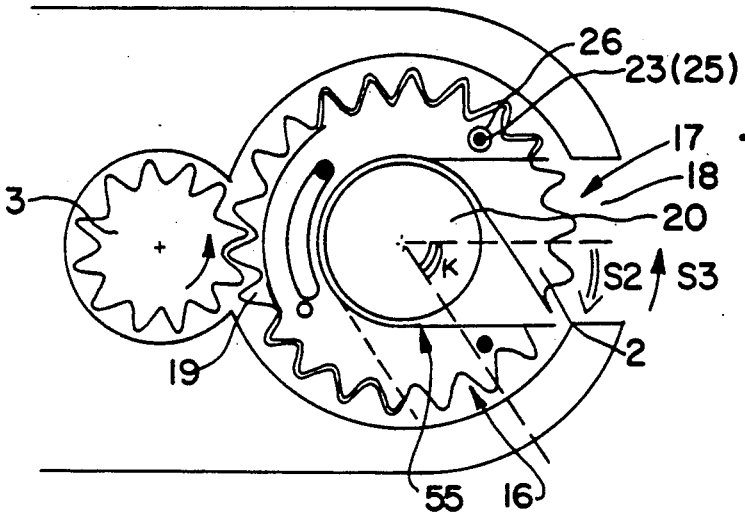

When the screw joint, or some other rotation has been completed, the ring gears 1 and 2 are returned to the position corresponding to FIG. 4, by rotating the gear 3. This return can be effected either by continuing to rotate the ring gears in direction S2 until the relationship shown in FIG. 4 has been reached, in which case the inner surfaces of the notches of the ring gears must slide in relation to the rod 20, or by rotating the ring gears 1 and 2 in the reverse direction, S3. In most cases, the fact that the rod 20 is in this case rotated less than one full rotation in the reverse direction, whereupon, for example, the screw joint opens respectively, has no importance in many practical applications, since, for example, in normal rock drilling the starting of the drill automatically removes any slack from the screws, thus finally tightening the screw joint.

Now that the ring gears 1 and 2 have been returned to the relative dispositions shown in FIG. 4, the tong is opened as follows to release the rod 20. To ensure the opening, there is provided in the ring gear 1 a pin 23, which is parallel to the longitudinal axis of the ring gear 1 and protrudes from the end surface 15 of the ring gear 1. This protruding part has an end surface shaped like a cone 24. In alignment with this pin 23, there is in the housing 11 a corresponding depression 25 in which the cone fits when the ring gear 1 is in the relative disposition shown in FIG. 3, in other words when the notch 17 is in alignment with the aperture 18. The pin 23 is provided with springs in a manner known per se. not depicted here, so as to press the pin 23 into the depression 25. When the cone 24 is in the depression 25, the other, flat end 27 of the pin 23 is disposed in the plane of the end surface 13 of the ring gear 1. In the corresponding end surface 12 of the ring gear 2 there is a depression 26 in which the end 27 of the pin 23 fits when the pin 23 has been moved against the spring force to such an extent that its conical part 24 is withdrawn completely inside the end surface 15 of the ring gear 1. The pin 23 and the depression 26 are situated, when the notches 16 and 17 of the ring gears are in mutual alignment, on the same circumferential line in relation to the axis of rotation of the ring gears and at a circumferential distance from each other, which corresponds to the angle $\alpha/2$ (k). In this case, when the ring gears are in the position indicated in FIG. 4, the cone 24 is located in the depression 25 and the depression 26 is located exactly in alignment with the pin 23. When the ring gears are rotated from the disposition shown in FIG. 4, in the direction S2, since the pin 22 at the end of the groove 21 keeps the ring gears locked to each other when rotated in this direction, the turning of the ring gear 1 forces the wedge formed by the cone 24 and the corresponding depression 25 to push the pin 23 against its spring force, whereupon the other end 27 of the pin pushes into the depression 26. The end 27 of the pin is located in the depression 26 during the rotation. When the gears are disposed in the positions shown in FIG. 4, and the purpose is to open the tong device, the gear 3 is rotated in the reverse direction, whereupon the ring gear 2 rotates in direction S3. At this time the ring gear 1 remains in place, since in this position the uncogged portion 19 of the periphery of the ring gear is in alignment with the gear 3 and since in this position the spring presses the cone 24 of the pin 23 into the depression 25. Thus, the ring gear 2 turns in direction S3 until its notch 16 is in alignment with the aperture 18, whereupon both ring gears 1 and 2 are in the position corresponding to FIG. 3. At this time, the tong 10 can be withdrawn from the rod 20 and be returned to its resting position.

The operation of the tong device is completely symmetrical; in other words, it can be used for gripping a rod and rotating it in a similar manner in either direction. In order to achieve this, the groove 21 is symmetrical in relation to the diameter of the notches 16 and 17. The second springed pin 33 with its conical end 34, depression 35 and its other end 37 and depression 36 is also symmetrically located to rotate the ring gears and thereby the rod 20 in a direction reverse in relation to the above.

Figure 6:
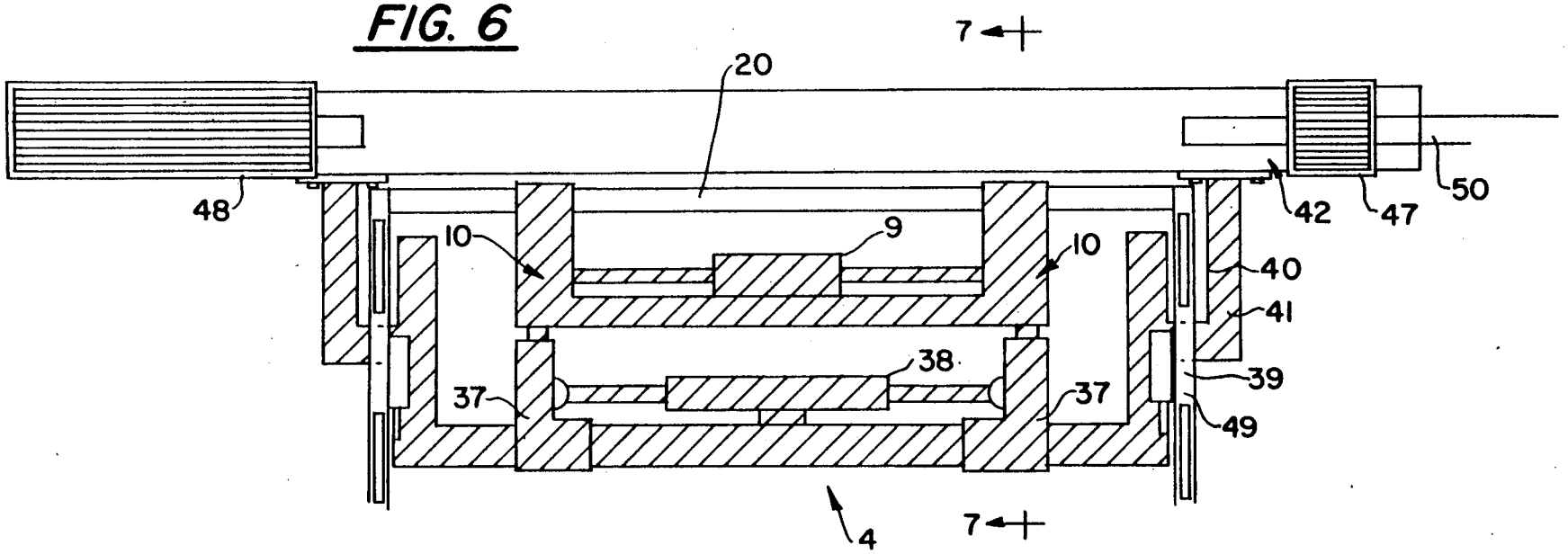
FIGS. 6 is a fragmentary vertical sectional view of the gripping and rotating tong device in FIGS. 1–5, with an associated transfer device, installed in a chain magazine.
Figure 7:
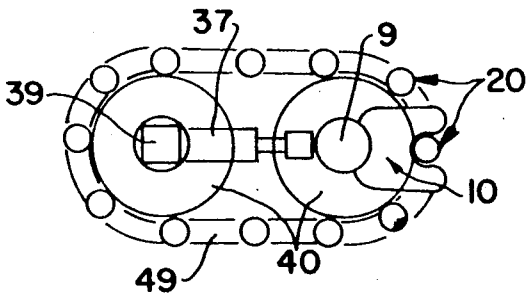
FIG. 7 is a reduced scale diagrammatic top plan view of the assembled apparatus of FIG. 6.

FIGS. 6 and 7 show how the gripping and rotating tong devices fastened to the transfer means 4 form a gripping and rotating unit 4 to be installed, for example, inside a chain magazine. In this case the gripping and rotating unit 4 is made up of two gripping and rotating tong devices 10, a motor 9 rotating the tong devices by transmission of gears 3, transfer cylinders 37 moving the tong devices between the magazine and the point of use, and a cylinder 38 which moves the tong devices axially. These said components form the gripping and rotating unit 4, which can be installed in connection with the mechanism desired. To illustrate the operation of the unit 4, FIGS. 6 and 7 also depict the placement of the unit inside the magazine; this magazine is made up of chain sprockets 40 and a chain 49 which runs on them, the rods 20 being located in spaces in the chain. The chain magazine is rotated by the drive device 39. This chain magazine with its drive device may be of any suitable type known per se, and therefore its operation is not described in greater detail. The gripping and rotating unit 4 and the chain magazine are in this case installed by means of bearing fastening parts 41 to the side of the feeding boom 42 of a rock-drilling machine. Also fastened to the feeding boom is the striking and rotating device 48 and detent 47 of the drill. The unit 4 with its tongs 10 takes a drill rod 20 from the chain magazine, transfers it onto the feeding boom as a continuation of the previous extension rod 50, rotates the rod 20 in such a manner that a screw joint is produced between the previous rod 50 held in place by the detent 47 and the introduced rod 20, whereafter the unit 4 returns its tong device 10 to the initial position inside the chain magazine. In the unit 4 the cylinders 37 effect the movement transverse to the rod, and the cylinder 38 effects the axial movement of the rod, by means of which the rod 20 is brought to the end of the rod 50, at the correct point longitudinally, and is transferred further to produce a screw joint.

Figure 8:
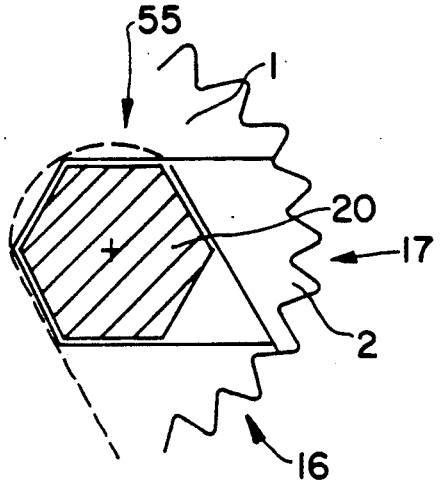
FIGS. 8, 9 and 10 are fragmentary top plan views, generally comparable to portions of FIGS. 2–5, showing alternatives for locking of the gripping and rotating tong device to the rod to be handled.
Figure 9:
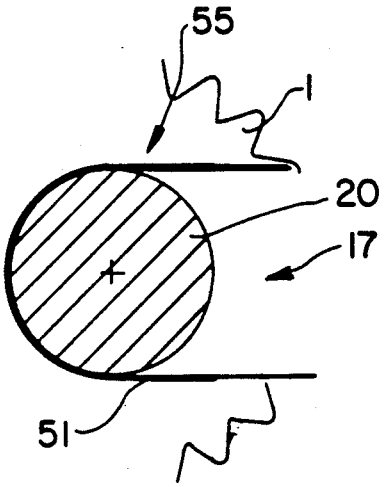
Figure 10:
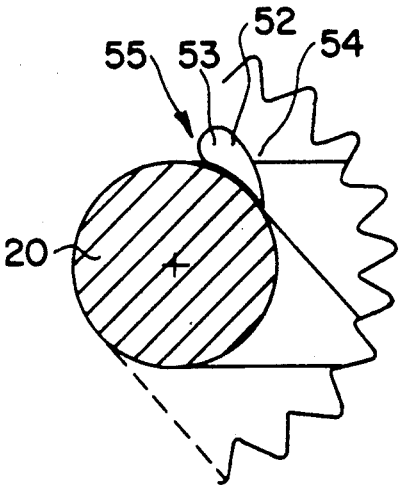

That construction detail by means of which the previously mentioned sufficient friction is produced between the rod 20 and the ring gear 1 is implemented according to the point of use in each given case, the manner of implementation being affected among other things by whether the rods to be handled always have the same diameter or whether this dimension varies and how much, whether the rod is circular or perhaps polygonal in cross section, and furthermore, how rough a handling the rod can withstand, in other words how precisely the pressure must be calibrated. FIGS. 8, 9 and 10 show some alternatives. In fig. 8, an angular rod is being handled, and it has been possible to shape the notch 17 at the walls 55 surrounding its center so as to correspond to the cross section of the rod. In this case the locking and rotation of the rod is very simple and reliable.

In FIG. 9, the inside of the notch 17, over the distance 55 corresponding to the diameter of the rod is coated with, for example, rubber 51, which by means of its elasticity and the pressure keeps the rod 20 in place.

FIG. 10 illustrates the principle of a cam alternative, in which a cam 52 has been embedded into the ring gear 2, into its end surface 12, and connected to the ring gear 2 by means of a shaft 53. At a suitable distance in the gear ring 1 there is located a pin 54, which protrudes from the end surface 13 of the ring gear 1 in such a manner that it is tangent to the outer side of the cam 52. When the ring gear 2 now turns over angle k in relation to the ring gear 1, the outer surface of the cam 52 slides against the pin 54 and produces by its inner surface a pressure against the rod 20. On the opposite side there are, of course, symmetrically in relation to the center line of the notches 16 and 17, the corresponding components for rotation in the reverse direction. A few methods possible for producing the pressure are described above, but in practical implementation this sufficient friction can be produced by any one of the methods described or by any other method known per se. When necessary, the ring gears of the tong device can be provided with replaceable or adjustable inner parts in the necessary area 55. In other words, gripping parts suitable for the rod in a given case are installed in the notches 16 and 17 or, if the question is of a cam alternative, it is also possible only to adjust the cam in question in accordance with the rod used. It is also possible to use a hydraulic, remote-controlled or self-controlled gripping-part construction.

Also some other structure of the gripping and rotating tong device itself may in its details differ from the embodiment described above. It can, for example, be thought that the mutual locking of the ring gears 1 and 2, for which now a groove 21, a pin 22 and parts 23–27 and 33–37 are used, is implemented so that the ring gears 1 and 2 can as such move freely in relation to each other but means for the mutual locking and releasing of these ring gears have been arranged in connection with the gear 3. In this case the gears 3 have been divided into two parts, one being responsible for the rotation of the ring gear 1 and the other for the rotation of the ring gear 2, and the mutual locking of these parts of the gear 3 has been arranged so that it corresponds to the mutual locking, described above, of the ring gears 1 and 2. Locking techniques and locking means of other types can also be used to achieve a function corresponding to the mutual locking of the ring gears 1 and 2 described above, and these locking means can be placed in any part of the mechanism. In general it is, however, most advantageous to install them directly in the ring gears 1 and 2.

The bearings of the ring gears 1 and 2 are preferably effected as slide bearings, because, for example, in producing a screw joint the rotary speeds and the number of rotations remain relatively low. It is, however, possible to use also other types of bearings according to the requirements of the point of use.

Figure 11:
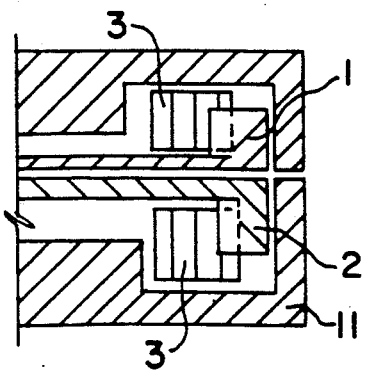
FIG. 11 is a fragmentary longitudinal sectional view, generally comparable to the rightmost portion of FIG. 1, showing another embodiment of the gripping and rotating tong device.

In the embodiment described, the cogging of the ring gears is external cogging on the periphery of the rings, but in situations and conditions of use in which, for example, the teeth should entirely be protected from external influences, the use of internal teeth on the periphery could be considered. In this case the structure may be, for example, similar to that depicted in FIG. 11, in which the ring gears 1 and 2 with their drive gears 3 have been installed inside the housing 11. The construction will be more complicated, but outwards all that will be visible of the ring gears is their smooth outer periphery.

One deviating embodiment of the invention is one in which the uncogged portion 19 of the periphery of the ring gear 1 extends over the entire peripheral length of this ring, i.e. the ring gear 1 is in fact an uncogged locking ring. In this embodiment the ring gears 1 and 2 can be made to rotate without interruption, for example, by installing two gears on the periphery of the ring gear 2, the distance between these gears being greater than the length of the peripheral portion of the notch 16. In this case, when the rings 1 and 2 are rotating, one of the said two gears is at every moment in contact with the periphery of the ring gear 2. These gears must, of course, rotate at the same speed in relation to each other. One possibility to effect uninterrupted rotation is to use screw transmission, in which case the cylindrical gear 3 is replaced, for example, with a spiral the length of which is greater than the length of the peripheral portion of the notch 16. Such a spiral is in the extreme situation in contact with the teeth of the ring gear 2 on both sides of the notch 16. Otherwise the mutual limiting and locking of the rings 1 and 2 can be implemented as in the other embodiments.

When the method of FIGS. 9 and 10 to press the rod 20 tightly to the center of the ring gear 1, or some other corresponding construction also producing tight pressing is used, the rods can be used in diverse ways, since in this case the rod cannot slip even in the vertical position from the center of the tong. In this case, the tong can be used not only for transferring drill rods, drill pipes and drill bits on the horizontal level but also for transferring them or, for example, rock bolts into some other position. According to the piece to be handled, the gripping and rotating tong unit 4 may include one, two or more gripping and rotating tong devices 10. It can also be thought that, for example, in the alternative of FIGS. 6 and 7, the unit 4, by means of two gripping and rotating tong devices 10, carries out the installing and removing of extension rods, and the tong-device 10 on the side of the object to be drilled alone carries out the replacing of the drill bit when necessary, in which case the unit 4 is transferred out from one end of the chain magazine which is against the rods, one tong device 10 is disconnected, and the other tong device takes a drill bit from another magazine, not shown, which is concentric with the chain magazine 40, 49, and installs the bit in its place in otherwise the same manner as the drill rods.

It can be pointed out as a further feature of the construction, that the gripping and rotating unit 4, as such or connected to a magazine of the desired type, can be retro-installed in drilling machines. When necessary, the unit can even be transferred from one machine to another and, if at this time the type of the rod 20 changes, this dimensional change can be taken into account by using replaceable inner parts in the ring gears 1 and 2.

I claim:

1. A gripping and rotating device for handling rods, comprising:

a movable transfer device;

a housing secured to said movable transfer device; said housing including wall means defining an exterior and an interior; means defining an opening axially through said housing and communicating with said interior; a radial aperture laterally intersecting said opening so that a rod can be taken laterally into said housing through said radial aperture, so as to extend axially from said housing through said opening along a longitudinal axis of said opening;

gripping means disposed in said interior of said housing for gripping a rod when taken laterally into said housing; said gripping means including two axially adjacent rings journalled by respective bearing means in said housing coaxially with said opening for rotation about said longitudinal axis;

each said ring having means defining a respective axial opening therethrough, coaxially with said axial opening through said housing, and means defining a radially opening notch laterally intersecting the respective said axial opening through the respective said ring so that a rod when being taken laterally into said housing can be taken laterally into said rings through the respective said radial notches, so as to extend axially from said rings through the respective axial openings through said rings along said longitudinal axis;

at least one of said rings being peripherally provided with a respective set of cogging centered on said longitudinal axis;

drive gear means journalled in said housing and arranged to be reversibly rotated in driving relation with said set of cogging for reversibly rotating said at least one of said rings about said longitudinal axis;

at least one of said rings having surface means facing the respective said axial opening therethrough and arranged for drivingly engaging said rod when extending through said axial openings, whereby said rod may be rotated about said longitudinal axis by rotating said drive gear means;

interengageable limiting means provided on rings and arranged to provide for a predetermined angular amount of lost motion between said rings upon rotation of said drive gear means in either angular direction, said predetermined angular amount being sufficient to relatively rotate said one of said rings relative to the other of said rings sufficient to cause said radially opening notches through said rings to be shifted between an open condition in which both of these notches overlap one another in effective radial alignment on one side of said longitudinal axis, and a closed condition in which these notches are substantially completely non-overlapping, through rotation of at least one of said rings by a predetermined angular amount.

2. The gripping and rotating device of claim 1, wherein:

each of said rings is peripherally provided with a respective said set of cogging;

the series of cogging on said one of said rings extending continuously around the respective ring from one angular extent of the respective radially opening notch of that ring, to the opposite angular extent of the respective radially opening notch of that ring; and the series of cogging on the other of said rings extending discontinuously around the respective ring from one angular extent of the respective radially opening notch of that ring, to the opposite angular extent of the respective radially opening notch of the ring, being interrupted throughout an interval of the periphery of said other ring which is diametrically opposite the respective radially opening notch of that ring, whereby said cogging on said other ring remains out of driven relationship with said drive gear means throughout respective intervals of rotation of said one of said rings sufficient to accommodate provision of said predetermined angular amount of lost motion.

3. The gripping and rotating device of claim 2, further including:

locking means comprising an axial pin axially reciprocally received in means defining an axial opening through said other one of said rings;

each of said rings being of a given thickness between two respective end surfaces; said other one of said rings having one end surface thereof disposed in confronting relation to an interior surface of said housing and an opposite end surface thereof disposed in confronting relation to one said end surface of said one of said rings;

said axial pin being longer than said other of said rings is thick;

means defining a first depression in said interior surface of said housing;

means defining a second depression in said one end surface of said one of said rings;

said first depression, said second depression and said axial pin all being located at a like given radial distance from said longitudinal axis, so that, in use, opposite end portions of said axial pin are alternately receivable in said first and second depressions;

urging means urging said axial pin in one axial direction such as to tend to urge a corresponding end portion of said axial pin into said first depression;

said first and second depressions and said axial pins being located relative to one another in a direction circumferentially of said longitudinal axis, such as to tend to pin said one and other rings together for joint rotation after being rotated through a given angle in a first direction, and, upon reverse rotation until said other ring achieves an angular disposition relative to said housing, in which said notch in said other ring is radially aligned with said radial aperture of said housing, on a same side of said longitudinal axis, whereupon, said urging means urges a corresponding end portion of said pin out of said second depression and a corresponding end portion of said pin into said first depression, thereby terminating rotation of said other ring while permitting said drive gear to further rotate said one ring.

4. The gripping and rotating device of claim 1, wherein:

said surface means facing the respective axial opening through said at least one ring is provided on a replaceable element, whereby each said element may be exchanged for another having different shapes, for fitting against correspondingly differently shaped rods.

5. The gripping and rotating device of claim 1, wherein:

said surface means facing the respective axial opening through said at least one ring is made of an elastic material, for gripping said rod.

6. The gripping and rotating device of claim 1, further including:

camming means for centralizing said rod in said axial openings of said rings, said camming means comprising a cam pivotally mounted on one of said rings and a pin, engageable with said cam and mounted on the other of said rings; said cam being arranged to engage said rod in a sense to urge said rod towards centrality in said axial openings of said rings.

* * * * *